US006210757B1

(12) United States Patent
Taylor et al.

(10) Patent No.: US 6,210,757 B1
(45) Date of Patent: Apr. 3, 2001

(54) PRESSURIZED ENCLOSED GRAVURE APPLICATOR AND METHOD

(75) Inventors: John A. Taylor, Pompton Plains, NJ (US); Thomas J. Lombardo, Oswego; Wolfgang L. Schaps, Baldwinsville, both of NY (US)

(73) Assignee: Black Clawson Company, Inc., New York, NY (US)

( * ) Notice: Subject to any disclaimer, the term of this patent is extended or adjusted under 35 U.S.C. 154(b) by 0 days.

(21) Appl. No.: 09/272,954

(22) Filed: Mar. 19, 1999

Related U.S. Application Data

(60) Provisional application No. 60/078,986, filed on Mar. 23, 1998.

(51) Int. Cl.[7] ..... B05D 3/12

(52) U.S. Cl. ..... 427/356; 118/261; 118/244; 118/410; 101/169; 101/366

(58) Field of Search ..... 101/169, 366; 118/261, 244, 410; 427/356, 428

(56) References Cited

U.S. PATENT DOCUMENTS

| | | | |
|---|---|---|---|
| 3,568,636 | 3/1971 | Lockwood . | |
| 3,631,800 | 1/1972 | Mignone et al. . | |
| 4,009,657 | 3/1977 | Bonanno et al. . | |
| 4,643,127 | 2/1987 | Wanke . | |
| 4,688,516 | 8/1987 | Sommer . | |
| 4,834,018 | 5/1989 | Sollinger et al. . | |
| 4,903,632 | 2/1990 | Sollinger . | |
| 4,958,561 | 9/1990 | Grosshauser et al. . | |
| 5,012,736 | 5/1991 | Van Kanegan et al. . | |
| 5,031,529 | 7/1991 | Greenwood . | |
| 5,054,392 | 10/1991 | Greenwood . | |
| 5,213,037 | 5/1993 | Leopardi, II . | |
| 5,325,775 | 7/1994 | Grosshauser et al. . | |
| 5,367,982 | 11/1994 | DeMoore et al. . | |
| 5,440,982 | 8/1995 | Meadows et al. . | |
| 5,497,702 | 3/1996 | Gorter . | |
| 5,611,860 * | 3/1997 | Waech | 118/410 |
| 5,671,673 | 9/1997 | Bööse et al. . | |
| 5,688,325 | 11/1997 | Aidum . | |
| 5,791,248 * | 8/1998 | Atkins et al. | 101/350.6 |

FOREIGN PATENT DOCUMENTS

| | | |
|---|---|---|
| 350950 | 2/1961 | (CH) . |
| 3446525 | 8/1985 | (DE) . |
| 368485 | 10/1989 | (EP) . |

OTHER PUBLICATIONS

Schilistra, D. "A Dynamic Flow of Ink", EFM, Jun. 1994.
Kamp, F., "A New Closed Chamber Doctor Blade System", FlexoTech, (Publication date unavailable, prior to Apr. 1996).
Deneka, P. K., "An Improved Means of Maintaining High Uniformity Transfer From Gravure and Anilox Rolls", Apr. 16, 1997, Quad Tech, Inc. Allentown, NJ.

* cited by examiner

*Primary Examiner*—Katherine A. Bareford
(74) *Attorney, Agent, or Firm*—Biebel & French

(57) ABSTRACT

An enclosed pressure gravure roll coating applicator, particularly designed for applying pressure sensitive films to web types substrates, and method of operating such coater. A downstream blade and an arcuately spaced upstream blade are positioned with respect to a roll to be coated. An intermediate gap-forming body between the blades forms a running gap with the surface of the roll to be coated. Substantially air free liquid coating is applied under pressure to an offrunning chamber adjacent the offrunning blade with excess coating flowing through the gap to an onrunning chamber adjacent the upstream blade. The pressure in the onrunning chamber is regulated at a relatively constant positive value sufficient to prevent air from entering the onrunning chamber past the upstream blade.

7 Claims, 2 Drawing Sheets

PRESSURIZED ENCLOSED GRAVURE APPLICATOR AND METHOD

PRIOR PROVISIONAL APPLICATION

Applicant claims the benefit of the filing date of Provisional Application Serial No. 60/078,986, filed Mar. 23, 1998.

BACKGROUND OF THE INVENTION

This invention relates to an enclosed pressure applicator and system and methods for coating gravure or anilox rolls.

There is an increasing tendency to use gravure printing for applying patterns of an adhesive material to a web, particularly pressure sensitive adhesives.

Pressure sensitive adhesives (PSA) are used for a variety of applications with a range of quality requirements. The most demanding application is that of protective films used on computer screens and windows. In this case optical clarity is the major concern; a concern very much affected by the application process.

The manufacturers of pressure sensitive films for computer screens and windows use extensive quality checks and manufacturing protocols to make a clear film free of bubbles, slugs, scratches, and haze—the last three usually caused by gels or clumps of latex particles. In some cases the protocol will basically require a shutdown and extensive cleanup every few hours.

All the above quality attributes add speed sensitive aspects to the process. A pressure sensitive latex particle is sticky and wants to stick to its neighbors, but this cannot be allowed to happen in the application process in that it would make gels, slugs, and debris that cause haze, streaks, and scratches. The opportunity for the latex particles to stick to each other is increased with increased shear or speed. On the other hand the uniformity of coating thickness or "coating lay" is enhanced by shear and one must "work" a viscous coating to some extent to get it to lay flat.

The competitive pressure is to improve clarity of the coating and at the same time to lower costs by reducing cleaning and shutdown times and/or increase speed of production.

Pressure applicators have been used to apply PSA coatings and ink to gravure rolls and anilox rolls. These pressure applicators may be located at about the 9 o'clock position, the 6 o'clock position, or the 3 o'clock position or at intermediate positions with respect to the roll. Generally, channeled gravure rolls, having a helix channel similar to a screw, are used so that there is always a path for the coating to flow under the blade.

A particular function of the pressurized applicator is that of removing the air in the gravure cells and substituting ink or coating therefore, with a weight of the coating being variable by varying the pressure within the applicator. Applying an air free coating to the applicator is important to prevent coating streaks.

Many designs of gravure pressure applicators emulate the designs of applicators that have been engineered for applying a coating material directly to a web supported on a roll. Such designs are not as successful as one might suppose. This is due at least in part, to the fact that the gravure applicator must perform a function that is not performed by coating applicators, namely, that of removing the air from the recesses or channels of the gravure roll and carrying the air out of the applicator without allowing it to affect adversely the quality of the coating. In a gravure applicator, thousands of small discrete air bubbles are released into the ink or coating material, a condition that does not obtain in the design of pressure coating for webs, and a problem that has not adequately been addressed in the design of pressure applicators for gravure rolls.

In any gravure coating or ink applicator, the coating is applied to a closed chamber and is doctored off the roll at the exiting side with a steel blade. Generally, the direction of flow within the chamber is parallel to or concurrent with the direction of rotation of the roll across the chamber opening.

Generally, the size of the gravure channels controls the coating weight. The chamber has end seals and often a number of inlets and outlets. The outlets are often of a larger diameter to maintain the internal pressure relatively low. In some instances, the chamber is not totally filled with ink or coating and an air space is maintained within the chamber. In those cases where the exiting blade is at the top, the coating can cascade inside the applicator and generate foam. The coating in any event will pick up air because the empty gravure cells release air bubbles into the reservoir.

Early enclosed applicators were not specifically pressurized except for the back pressure required to get the coating out of the applicator. More recently, enclosed pressure applicators have been used, and the amount of pressure controls the weight of inking or coating. The channeled gravure roll provides a path for the coating to flow under the blade, and coating weights can be varied from 100% to 150% of the cell volume. Internal pressure within the applicator prevents air from entering the reservoir by forcing air out of the grooves as they enter.

Existing pressure applicators have certain inherent problems. One problem is that of variation in pressure within the chamber. Since the fluid inlet pressure (at the roll inlet side) has been used to control the coating weight, it is extremely difficult to exclude air using this pressure. If the pressure is too high, the coating will bleed from the inlet and if it is too low, it will let air into the chamber. Since pressure is used to control coating weight in existing applicators, the internal pressure is never right for the entering conditions. An applicator is needed in which the inlet and outlet pressures may be independently controlled, and this concept is lacking in existing enclosed applicators.

A variety of closed chamber applicators have been designed in an attempt to deal with the entrained air that must be purged from the channels, and to prevent the influx of air and prevent air from degrading the filling or the coating results. Examples are shown in U.S. Pat. Nos. 5,054,392, 5,031,529, 5,497,702, 5,213,037 and EPO Patent 0368485. Some systems have included barriers to deaerate the coating prior to entering the channels. Others have established rotation or vortical flow within chamber cavities, but such flow can develop or form an air bubble in the center, which is undesirable. Most applicators employ a concurrent flow path for the coating material so that the coating material flows with the movement of the roll surface, not against it. That means that the entrained air bubbles move toward the exit blade and accordingly have the greatest chance for disturbing the integrity of the cell-filling process and are then carried back through the system with the overflow coating.

SUMMARY OF THE INVENTION

This invention relates to a closed countercurrent flow pressure applicator, applicator system, and method in which the direction of flow through the applicator is opposite to the direction of rotation of the roll at the applicator opening. The applicator forms a coating entrance side or chamber at the off-running side of the roll and the coating exit side or chamber at the on-running side of the roll, separated by an intermediate body which forms a clearance gap between itself and the roll surface. The incoming coating is made free of air and filtered, and applied to the gap under pressure. Preferably, an inlet feed slot is fed from a tapered inlet header which header is wider at the side where the coating enters the applicator, to maintain a scouring flow in the header across the full width of the applicator.

The coating travels in the applicator against the motion of the roll through a narrow channel or gap parallel to the roll surface defined by the intermediate body, and exits the chamber through a substantially wider slot into a tapered collection header or collection passageway on the exit side of the applicator. This taper also allows cleaning by flushing similar to that of the distribution header.

The intermediate body divides the coating chamber of the applicator into an upstream off-running side with respect to the direction of rotation of the roll and downstream on-running side, with the previously mentioned clearance gap extending between these respective sides or chambers, and the ink or coating material flows from the previously described tapered header into a chamber portion formed at the off-running side, and through the generally parallel gap between the intermediate body and the roll to a chamber formed at the on-running side, hereinafter referred to as an on-running chamber.

Pressure within the on-running chamber is controlled by an adjustable stand pipe arrangement which accurately maintains a substantially constant pressure head in the on-running chamber that is independent of flow rate. This pressure head can be set to match that required to keep air from entering the chamber cavity. As noted above, the coating enters the off-running chamber through a metering slot at a controlled rate. The coating travels against the motion of the roll through the channel or slot defined between the roll and the intermediate body. In practice, the flow establishes a pressure drop and in turn, the pressure in the roll exiting cavity. This channel is in high shear [so that air which is] left in the gravure channels is swept out as small bubbles by the direction of coating flow into the on-running chamber within the applicator at the gravure roll entering side. In other words, the shear of the coating flowing from the entrance to the exit, contra to the direction of roll movement, serves to purge any remaining air from the gravure channels with the air bubbles being directed away from the exit blade and into the on-running chamber.

As noted above, the passageway formed in the applicator at the inlet and outlet sides are preferably tapered to form collection chambers which respectively empty into or from slots formed along the intermediate body at each of its sides. The flows through the respective inlet and outlet cross-machine distribution cavities are maintained at a scouring rate by having the inlet feed header and outlet collection header tapered so that the rate of flow tends to remain relatively constant within these headers.

The novel and unobvious advantages of the applicator according to this invention may be summarized as follows:

1. Deaerated coating is injected at the gravure roll exiting blade side of the applicator. This means that the exit blade sees only filtered deaerated coating. This is particularly important for applying pressure sensitive adhesives since air bubbles cause slag or dried coating to hang up on the blade tip, and cause streaks. The applicator uses a regulated pressure to prevent air from entering with the gravure roll. Further, this applicator uses the excess coating flow to scour out any air remaining in the gravure channels, then fully rejects this coating out of the applicator for deaeration and filtering before returning to the applicator. There is a minimum of intermixing of the air with the deaerated coating at the inlet side of the applicator. Preferably, quality deaeration equipment is employed on the coating inlet side such as that shown in U.S. Pat. No. 5,149,341.

2. The applicator of this invention provides for independent control of the pressures in the exiting blade chamber and the entering (on-running) blade chamber. The latter is controlled by a standpipe or other pressure regulation arrangement independent of flow rate. The exiting blade side chamber can be controlled by flow rate and by back pressure developed by passing through the metering slot and the pressure formed by the parallel gap with the roll.

3. The applicator of this invention uses a relatively small volume of coating within the applicator, thereby providing a high turnover rate to keep the coating clean and save coating materials.

4. The applicator according to this invention has certain features that are considered to be unique for this class of apparatus. Thus, a generally parallel channel is formed between the intermediate body and the gravure cells, which performs a better job of scouring the air out of the gravure roll channels. Additionally, the apparatus forms on-running and off-running blade chambers in which the pressures are independently controlled, the entrance or lead in chamber (the chamber adjacent the exit blade) being controlled by the flow rate and its resistance to flow through the gravure roll/body gap. The outlet or collecting chamber (adjacent the inlet blade) is controlled at a constant pressure by a regulating pressure head device, e.g. the height of a standpipe has very little pressure drop so that the pressure seen by the roll entering blade is independent of flow rate or viscosity. Since the pressure in the on-running chamber is regulated and controlled to be relatively constant, a pressure can be selected that prevents excess air from being entrained past the entrance blade and avoids conditions where excessive pressure can cause back flow of coating through the entrance blade. The channel or gap between the intermediate body and the gravure roll is sized to provide back pressure so that the off-running chamber operates at a higher and flow resistance regulated pressure.

It is therefore an important object of this invention to provide a counter flow type of gravure coating applicator and method in which the pressure in the gravure roll on-running chamber is maintained at a relatively constant value.

A further object of the invention is to provide a counter-flow coater with deaerated coating or inking material at an inlet side that is also the exit side of the gravure roll and causing such coating to flow against the rotation of the roll through an accurate slot or gap defined by an internal separator body to an outlet side in which the pressure is maintained by the flow rate through such slot independently of the pressure in the roll inlet side, and in which air bubbles scoured out of the gravure channels are prevented from intermingling with the deaerated coating at the inlet side.

A still further object of the invention is the provision of an applicator with tapered inlet manifolds and outlet collection passageways that are proportioned to have scouring flow therethrough to prevent stagnation.

Other objects and advantages of the invention will be apparent from the following description, the accompanying drawings and the appended claims.

DETAILED DESCRIPTION OF THE PREFERRED EMBODIMENT

Figure 1:
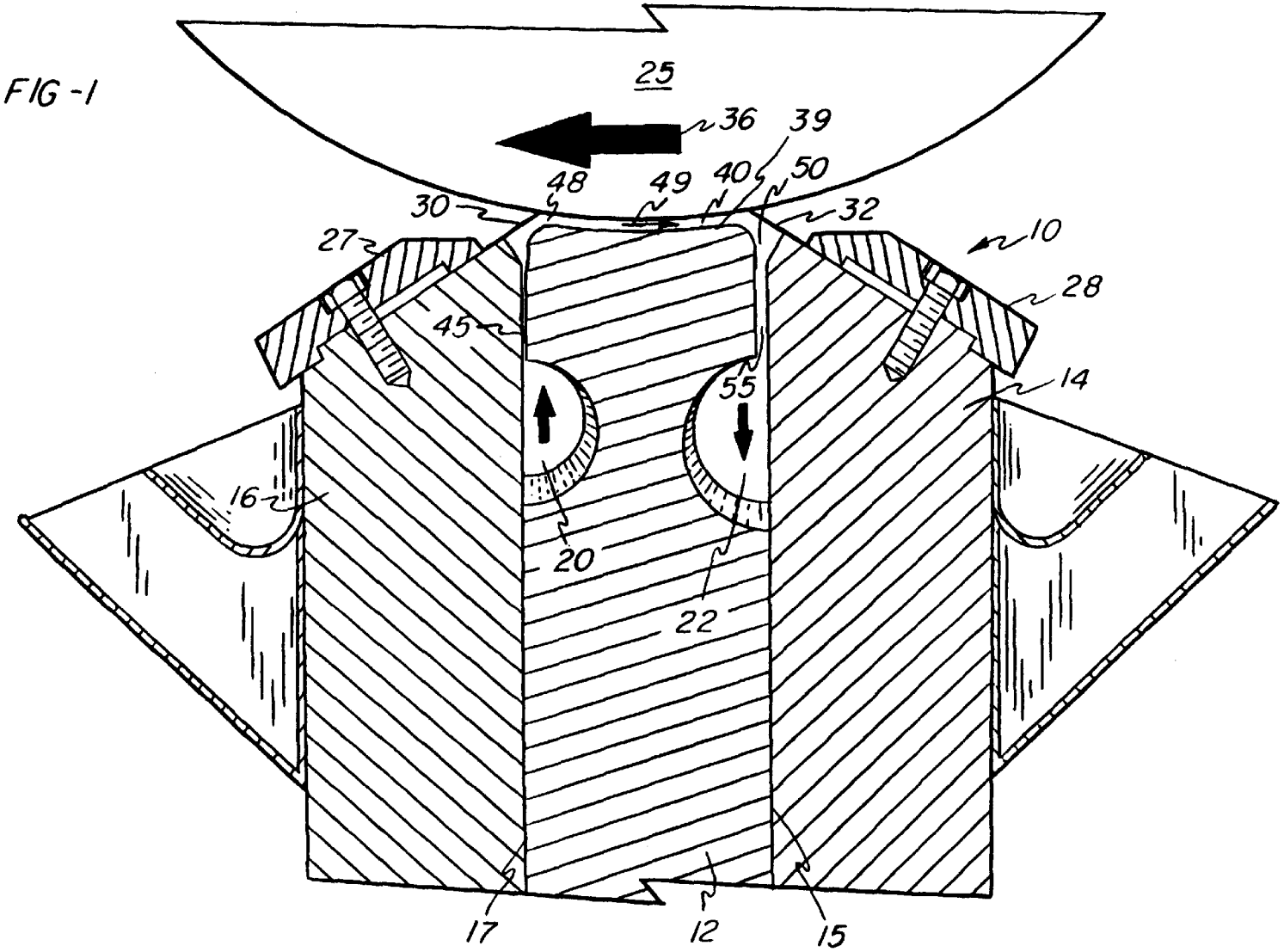
FIG. 1 is a somewhat diagrammatic cross-sectional view of a coating applicator for gravure or anilox roll according to this invention.

FIG. 1 represents a cross-sectional view through a gravure roll ink or coating applicator 10. The applicator 10 has a central or intermediate body 12 and a pair of side bodies 14 and 16 bolted to opposite sides of the body 12. The body 12 is formed with generally planar side walls 15 and 17 to form a mating surface with the side bodies 14 and 16, in which side bodies function as blade holding bodies. The side bodies 14 and 16 mate with and close with the central body 12 along the side wall surfaces 17 and 16 at the lower end, but at the upper end, define the wall of a tapered inlet header 20 on one side, cooperating with the body 16, and a tapered outlet header 22 on the opposite side of the body 12, cooperating with the body 14. It may be preferred to form the header passageways 20 and 22 in the respective side bodies 16 and 14 for ease of access and cleaning.

The side bodies 14 and 16 are doctor blade holders and each support a blade on an upper inclined surface, so that the end of the blade is in co-acting relation with the surface of a gravure roll 15. Preferably, the applicator is placed at the 6 o'clock position to better balance the pressures therein, but it is within the scope of the invention to place the applicator at orthogonal positions such as 3 o'clock and 9 o'clock or at positions in between.

The body 16, at its upper surface, is provided with a clamp 27 to position an off-running or downstream coating blade 30. Similarly, the body 14 is provided with a clamp 28 to support and position an on-running or upstream coating blade 32. The direction of rotation of the gravure roll 25 is indicated by the arrow 36 and on-running and off-running blades are defined in terms of the movement of the roll 25 over the applicator 10. The blades 30 and 32 form acute angles to the surface of the roll so that the blade 30 is inclined against the direction of roll rotation and is the primary coating blade, while blade 32 is inclined in the direction of rotation and becomes the air-excluding blade and prevents back flow of coating or inking material out of the coater.

The intermediate body 12 is formed with an upper arcuate face having a radius of curvature approximating that of the roll 25 thereby defining a flow channel defined by a narrow gap 40 from the roll surface. This spaced relation between the arcuate upper surface 39 and the roll is defined herein as a "parallel" relationship but it may be more accurately defined as a substantially constant gap relationship.

The tapered inlet header 20 opens along the top at a narrow clearance gap or inlet flow passage or slot 45 between the body 12 and the surface 17 whereby coating material is applied into a small volume off-running chamber 48 in common with an inlet end of the gap 40. The chamber 48 is, to the coating, an inlet chamber and to the roll 25, an exiting or off-running chamber, closed by the blade 30. The coating applied, as described below, is air free and this air free coating contacts the roll surface at the chamber 48 and in the slot or gap 40. Fluid flows in the channel or slot in the direction of arrow 49 into a small volume fluid outlet chamber 50 also called an on-running chamber, having a wall defined by the on-running blade 32. The chamber 50 is an exit chamber for the fluid flow and an entrance chamber to the roll 25. The chamber 50 communicates with the outlet header 22, previously described, through a gap or channel 55, between the body 12 and the body 14.

It will be noted that the flow 49 in the channel or gap 40 is against, not with, the direction of rotation of the roll 25. Fluid is brought into the chamber 48 at a controlled rate through the slot 45. As previously noted, the headers 22 and 20 are tapered, that is they are largest at an inlet and narrowest at the end remote from the inlet, so that a scouring flow may be maintained. If desired, the tapered and narrow ends may be tapped to form a bleed through flow, if desired, to maintain the headers clear of obstruction, and in effect, self cleaning. Where the inlet and outlets are conveniently placed at one remote end of the applicator 10, then the tapers for each of these headers or passageways can be in the same direction, that is the widest or largest at the inlet end and the smallest at the remote end or they can be in the reversed direction.

As the roll 25 rotates in the direction of the arrow 36, entrapped air in the helix channels, in the case of a helically grooved gravure roll, encounters coating forced under the blade by the internal pressure of the applicator and is not allowed to enter the applicator. The width of the gap or slot 40 may be such as to control the pressure within the downstream or offrunning chamber 48 and to provide a scouring and high shear flow therethrough, and this width of the gap 40 be as narrow as 0.01" or as great as 0.090" or more, depending upon the nature of the coating material, the surface speed of the roll 25, the depth of the channels and other variables. The entrance slot 45 providing fluid flow from the distribution header 20 into the cavity or chamber 48 is relatively narrow, such as in the order of about 0.012 inches to provide a uniform flow rate across the width of the coater.

As the fluid flows in the direction of the arrow 49 in the gap 40, its counter movement assists in scouring any air out of the gravure channels which air is then entrained as small bubbles with the flow and moves away from the downstream blade 30 into the chamber 50. This arrangement therefore provides a pool of coating material under pressure in the cavity or chamber 48 at the blade 30 which is totally or substantially free of air that could impair the quality or integrity of the coating applied to the roll 25.

Figure 2:
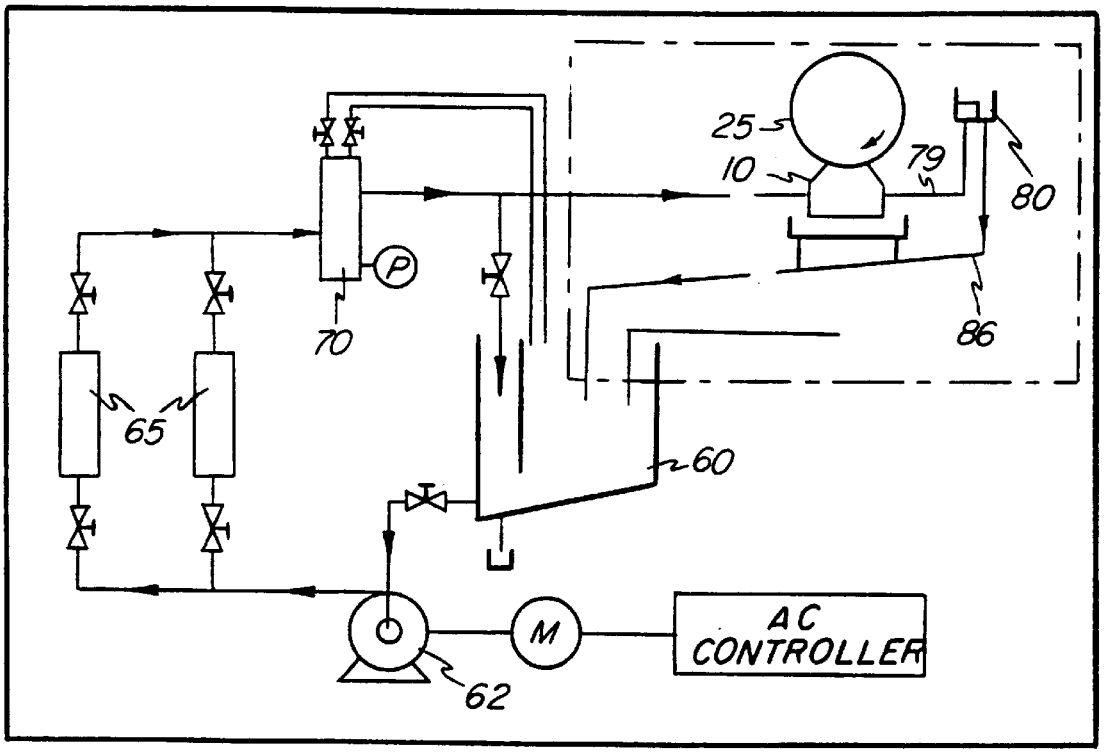
FIG. 2 is a flow chart showing a preferred arrangement of the components making up the coating system.

The pressure within the chamber 50 is independently controlled at a low but regulated value as described below in connection with the flow diagram (FIG. 2). By maintaining a relatively constant pressure in the chamber 50, a condition can be maintained such as to match that required to keep air from entering this cavity past the blade 32 and to prevent coating from weeping past the blade, as a is result of too high a pressure. The passage 55 leading from the chamber 50 into the return header 22 will be relatively wide compared to the width of slot 45, such as, for example, in the order of 0.080 inches.

Referring to the flow diagram of FIG. 2, a supply of the material to be applied, such as ink or coating is contained in tank 60. The gravure applicator of this invention is particularly adapted but not limited to the use of pressure sensitive adhesive coatings. Coating is withdrawn from the tank 60 by a pressure pump 62 and delivered to one or the other of selectable filters 65 to an air purger or separator 70. The separator 70 is preferably apparatus as disclosed in U.S. Pat. No. 5,149,341 incorporated herein by reference.

Figure 3:
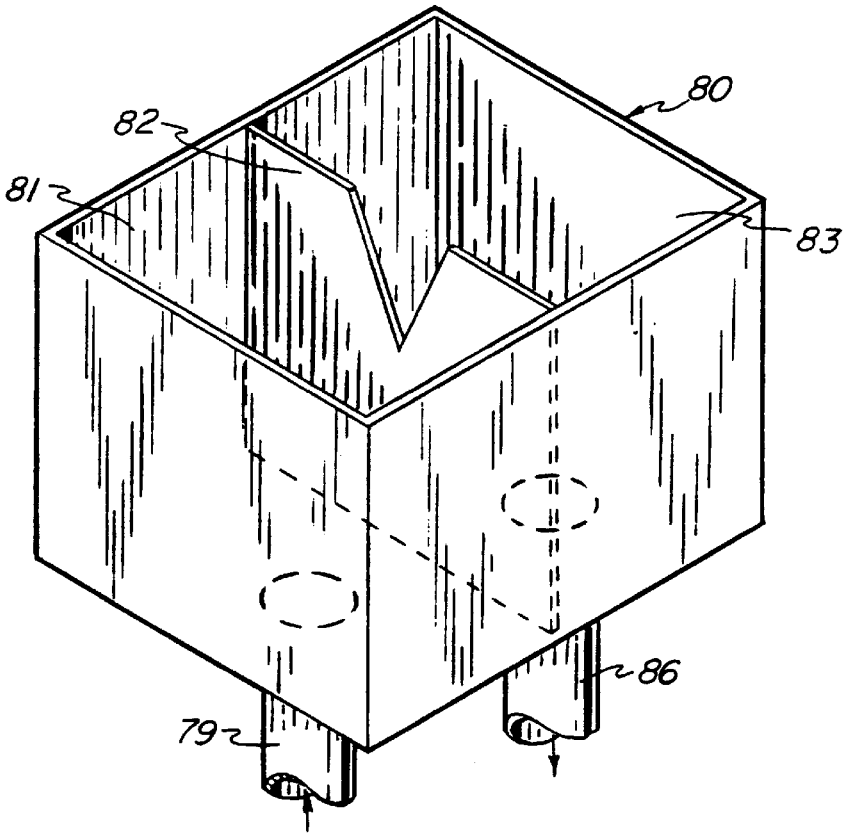
FIG. 3 is a perspective view illustrating the principles of a weir standpipe used to maintain a constant pressure.

The output from the air purger or air separator 70 is applied at a controlled rate, to the applicator 10 by applying the air free material to the inlet end of header 20. The pressure drop from chamber 48 to chamber 50 is controlled by flow rate but is affected by roll speed, viscosity and gap 40. The material flowing out of header 22 is connected by line 79 to an automatic pressure regulating device preferably in the form of an overflow weir 80 as shown in FIG. 3. An overflow weir 80 is elevated above the level of the applicator 10 to provide a predetermined and desired head, and the air laden coating material flows from line 79 into the first compartment 81, through the slot in a V-slotted weir plate 82, and down into an outlet compartment 83 and into the return pipe 86. The level of fluid in compartment 81 defines the pressure head in chamber 50. Such overflow weirs are well known in the art and fairly accurately control and provide a constant head in the chamber 50.

The air laden coating is then returned from the weir chamber 83 through a line 86 to the tank 60.

Good results have been obtained with a pressure applicator, described according to this invention in which the supply cavity 20 feeds into a slot orifice 45 of about 0.020" in width. The small of running chamber 48 at the doctor blade has a dimension of about 0.1"×0.1". The coating then flows against the direction of the roll 25 to the onrunning chamber 50 followed by a slot 55 of about 0.080" in width and into the second tapered cavity or outlet port 22. The deaerator process and apparatus, as defined in 70 in FIG. 2 is preferably positioned downstream of the filters 65, as shown, but may be place upstream of the filters. The particular air removal preferred apparatus, according to U.S. Pat. No. 5,149,341, works better with filtered material. A air free coating in some cases could also be obtained by using a settling tank 60 of sufficient size so as to let the bubbles rise to the top.

In the same example, the pressure regulating tank controls a controlled column pressure, translated into a column of water of between of about 6 to about 12 inches of pressure and experience has found that no air will enter to coating past the blade and in appropriate circumstances, such as a sufficiently long dwell time in a sufficiently large tank, the deaeration equipment or air separator may be eliminated.

Flow rates of 0.3 gallons per minute across 40" of deckle, providing an application rate of 0.008 gallons per inch [per minute], have provided good results. Excellent results have been obtained in the range of 0.008–0.4 gallons [per inch] per minute. Also good results have been obtained with a pressure 50 in the chamber at 12" of water equivalent. A gap 40 of about 0.060" has provided satisfactory results.

Generally, the pressure in the application chamber 48 is higher than that in the chamber 50 and the pressure in the chamber 48 regulates the coating weight. Accordingly, the coating weight may be changed by changing the flow rate to the applicator. Good results have been obtained, under the conditions described above with this example, operating at a roll 25 surface speed of 800 feet per minute.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. The method of applying a coating material to a rotating grooved gravure roll by a coater that has a downstream blade and an arcuately spaced upstream blade, each blade placed against such a gravure roll, and each blade positioned in relation to the direction of rotation of such grooved gravure roll and whereby the coater has an intermediate gap-forming body between the blades, whereby an offrunning coating chamber is formed by the gap-forming body, the gravure roll, and the downstream blade, an onrunning coating chamber is formed by the gap-forming body, the gravure roll, and the upstream blade, and with the roll a gap is formed connecting such chambers, with fluid passageways opening into such chambers for the delivery or removal of liquid coating material therefrom, comprising the steps of:

applying substantially air free liquid coating material under pressure to the passageway leading to said offrunning chamber and causing said liquid coating material to move through said gap into onrunning chamber, and causing an excess of such coating material to flow out through the passageway associated with said onrunning chamber;

regulating the liquid pressure in said onrunning chamber at a relatively constant positive value, said pressure being sufficient to prevent air from entering the onrunning chamber as the gravure roll rotates past the upstream blade through said roll grooves; and regulating the liquid pressure in said offrunning chamber to control coating weight by means of controlling the rate of coating material flow into said offrunning chamber and the flow resistance of the gap leading to said onrunning chamber.

2. The method of claim 1 in which said regulated pressure in said onrunning chamber is between about 5 and 12 inches of water.

3. The method of claim 1 in which said gap has a width of between about 0.010" and 0.9".

4. The method of claim 3 in which said gap width is about 0.060".

5. The method of applying a liquid coating to the recesses of a rotating grooved gravure roll by an applicator in which the applicator has an onrunning blade placed against the gravure roll in an upstream position in relation to the direction of rotation of the gravure roll, an offrunning blade placed against the gravure roll in a downstream position also in relation to the rotation of the gravure roll, and whereby a first chamber is formed at the onrunning blade, a second chamber is formed at the offrunning blade, and a flow constriction passageway bordered on one side by the gravure roll is provided between the blade chambers, such that the first chamber is formed by the onrunning blade, the gravure roll and the passageway, and the second chamber is formed by the offrunning blade, the gravure roll and the passageway, comprising the steps of:

applying liquid coating under pressure to the second chamber in sufficient volume to cause such coating to flow in a direction contrary to said rotation of the gravure roll through said flow constriction passageway to the first chamber, and maintaining the pressure of coating in the first chamber at a relatively constant value sufficient to exclude air from entering said first chamber between the onrunning blade and the surface of the gravure roll as the gravure roll rotates past the onrunning blade.

6. The method of claim 5 in which the coating material is applied to said second chamber at a rate of between about 0.08 gallons per minute per inch of roll width to about 0.2 gallons per minute per inch of roll width.

7. The method of claim 5 in which said relatively constant value is between about 6" to about 12" water column pressure.

* * * * *